United States Patent [19]

Pankoke

[11] Patent Number: 4,555,988

[45] Date of Patent: Dec. 3, 1985

[54] DEVICE FOR APPLYING SURFACE PRESSURE TO ADVANCING WORKPIECES

[75] Inventor: Werner Pankoke, Bielefeld, Fed. Rep. of Germany

[73] Assignee: Firma Theodor Hymmen KG, Bielefeld, Fed. Rep. of Germany

[21] Appl. No.: 592,683

[22] Filed: Mar. 23, 1984

[30] Foreign Application Priority Data

Mar. 24, 1983 [DE] Fed. Rep. of Germany ..... 3310700

[51] Int. Cl.[4] ..... B30B 5/06

[52] U.S. Cl. ..... 100/154; 100/211; 425/371; 156/583.5; 277/34.3

[58] Field of Search ..... 100/118, 119, 120, 151, 100/152, 153, 154, 211; 162/358; 425/371, 405 R; 156/583.5, 583.1, 582; 277/34, 34.3, 34.6

[56] References Cited

U.S. PATENT DOCUMENTS 3,839,147 10/1974 Daane ..... 100/154 X 4,331,073 5/1982 Girola ..... 100/154

4,420,359 12/1983 Goldsworthy ..... 100/154 X

FOREIGN PATENT DOCUMENTS 1078083 3/1960 Fed. Rep. of Germany ..... 277/34.3

*Primary Examiner*—Peter Feldman

*Attorney, Agent, or Firm*—Sprung Horn Kramer & Woods

[57] ABSTRACT

In a device for applying surface pressure to advancing workpieces like boards of wooden material etc. with at least one continuous compression belt against the inside of which a compression plate acts, several pressure chambers are distributed along the width and/or the length of the effective pressure surface of the belt. Each pressure chamber consists on the one hand of a sealing strip and on the other hand of the facing surfaces of the compression plate and of the compression belt. The sealing strips are resiliently secured against and can be released from the compression plate by a strip-like diaphragm that demarcates a pressure space.

10 Claims, 8 Drawing Figures

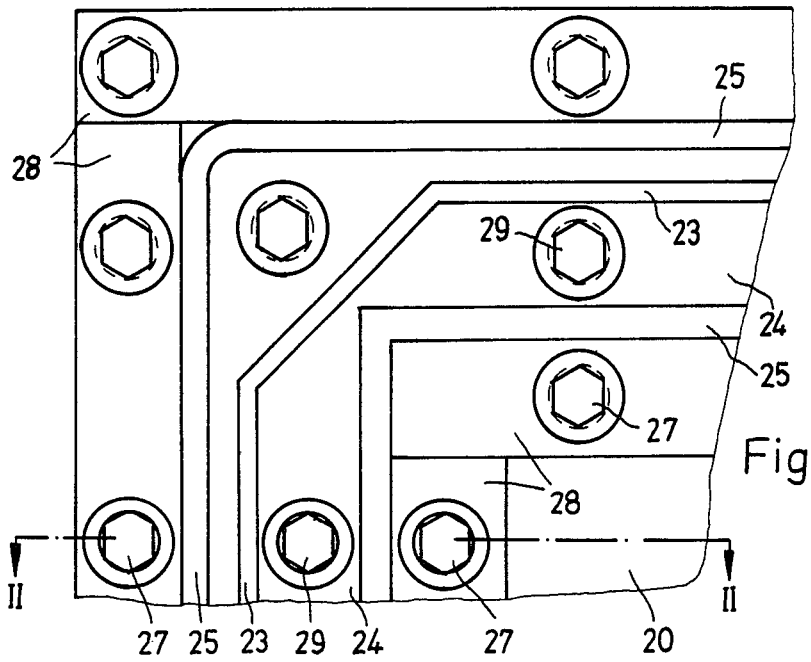
Fig. 1
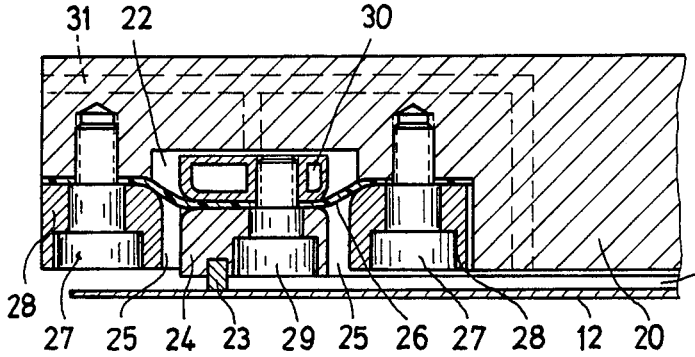
Fig. 2
Fig. 3
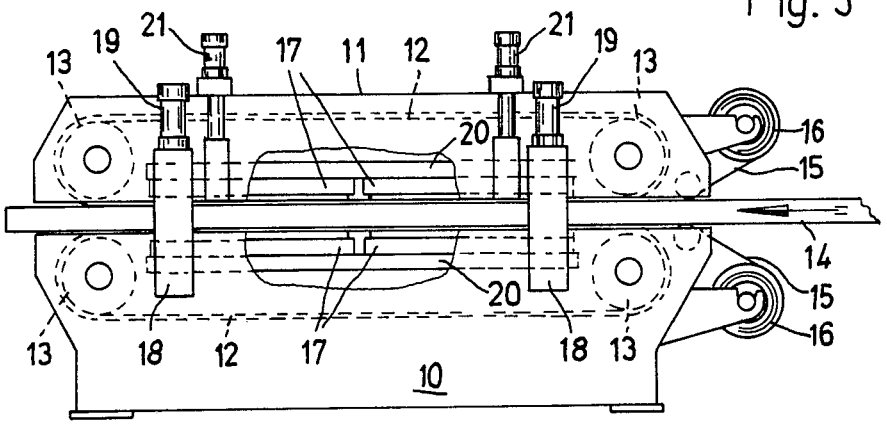

DEVICE FOR APPLYING SURFACE PRESSURE TO ADVANCING WORKPIECES

BACKGROUND OF THE INVENTION

The present invention relates to a device for applying surface pressure to advancing workpieces like boards of wooden material etc. in which at least one revolving compression belt can be forced against a workpiece by means of a pressure-application mechanism that can be introduced in a pressure chamber adjacent to the compression belt and sealed off by means of a continuous sealing strip and in which the compression belt is directed along the sealing strip.

SUMMARY OF THE INVENTION

The object of the present invention is to provide a device of the aforesaid type in which the continuous sealing off of the pressure chamber from the compression belt can also be obtained at higher operating pressures without loss of pressure medium.

This object is attained in accordance with the invention in that the pressure chamber is attached to a sealing strip which demarcates its outer edges, by means of a frame or, directly, to a strip-like diaphragm that constitutes an additional elastic seal and that surrounds it in the vicinity of the edges of the pressure chamber in that the edges of the diaphragm are secured to a compression plate and sealed off against pressure medium, and in that the side of the diaphragm that faces away from the sealing strip is subjected to pressure.

Further characteristics a surrounding groove positioned in the vicinity of the edge of the compression plate with the edges of the diaphragm tensioned against the walls of the groove and pressure medium introduced into the space demarcated by the surfaces of the groove and by the diaphragm. The side of the elastic diaphragm that faces away from the sealing strip is preferably connected to a hose that can be filled with pressure medium and the space inside the pressure-medium hose preferably communicates with a compressed-air line in the compression plate.

Moreover, a holder pointing toward the compression belt is fastened to the pressure-medium hose with the diaphragm in between them by means of screws. The diaphragm is preferably attached to the compression plate by means of lateral retaining strips that are penetrated by screws. The pressure-medium hose can be replaced by a rigid strip that is attached to and can be released from the holder. Further a sealing strip is preferably directly attached to the side of the diaphragm that faces the compression belt. The diaphragm preferably has a groove that partly accommodates the sealing strip or an accommodating groove positioned in a rib. Still further, the frame is preferably attached to the side of the diaphragm that faces away from the compression belt and the sealing strip penetrates the diaphragm.

Some preferred embodiments of the invention will now be described with reference to the attached drawings, wherein

BRIEF DESCRIPTION OF THE DRAWINGS

FIG. 1 illustrates a bottom view of one corner of a rectangular compression plate in accordance with the invention as viewed from the compression-belt side, FIG. 2 illustrates a partial section along line II—II in FIG. 1 and includes the holder for a compression-belt seal that involves an elastic diaphragm, FIG. 3 is a side view of the device in accordance with the invention with an upper and a lower compression belt.

DETAILED DESCRIPTION OF THE PREFERRED EMBODIMENTS

Figure 4:
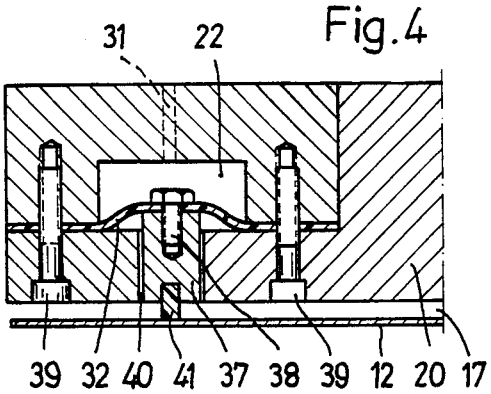
FIG. 4 is a partial section along line II—II in FIG. 1 of a variant embodiment.

The device in FIGS. 1–3 has a lower frame 10 and an upper frame 11 with a compression belt 12 built into each. Compression belts 12 are tensioned over and powered by pulleys 13. There is a space between them that equals the width of the workpiece 14 being processed. Workpiece 14 is introduced into the device, specifically into the space between the surfaces of compression belts 12, and pressure is applied to it by the surfaces, with the surface of each belt that comes into contact with the workpiece 14 moving horizontally. Workpiece 14 is accordingly processed as it travels through the device and leaves the space between the belts in the form of a finished piece as it exits from the device.

In the present example films 15 are obtained from supply reels 16 and compressed against the bottom and top of workpiece 14. Although a compression process of this type can be carried out at room temperature, heat can also be applied to the workpiece while it is in the processing area. The desired pressure can be attained by forcing upper frame 11 as a whole against lower frame 10 or pressure can be produced, after coarsely adjusting the distance between the frames, by means of compressed air in certain pressure chambers 17 positioned at the rear of compression belts 12 in relation to workpiece 14 or, in other words, against the surface of the belts that is not in contact with the workpiece.

Coarse adjustments are made in the present example by means of guide slots 18 rigidly positioned on lower frame 10 with upper frame 11 sliding up and down in them. Sliding is powered by hydraulic cylinders 19. Pressure chambers 17 are demarcated by compression plates 20 that are directed along frames 10 and 11 and moved by hydraulic cylinders 21.

The surface of compression plate 20 that faces the compression belt is surrounded by a groove 22 for fastening a sealing strip 23. When the device is assembled, sealing strip 23 rests against compression belt 12, which travels along the seal when operating. Hence, pressure chamber 17 is demarcated by the surface of compression plate 20, by the surface of compression belt 12 that faces away from workpiece 14, and by penetrating sealing strip 23. Pressure medium can be introduced into pressure chamber 17 through openings in compression plate 20.

Sealing strip 23 is secured in groove 22 by a holder 24 that is also surrounded by a groove, which opens toward compression belt 12 and accommodates sealing strip 23, which is rectangular in cross-section. Holder 24 is mounted in such a way that it can slide perpendicular to compression belt 12 inside groove 22, whereas sealing strip 23 is mounted immovably inside holder 24. Holder 24 is narrower than groove 22, leaving a gap 25 between them. The gap 25 illustrated in FIG. 2 is about the same width on each side for example. There is an elastic seal in the form of a diaphragm 26 against the surface of holder 24 that is farthest inside groove 22 and that parallels compression belt 12. Elastic diaphragm 26 is stretched at the edges of its longer sides against the wall of groove 22 (compression plate 20), sealing off the space inside the groove from the atmosphere.

The edges of elastic diaphragm 26 are fastened into and can be released from compression plate 20 with screws 27. One or more retaining strips 28 that constitute gap 25 are positioned for this purpose on both sides within compression plate 20. The inside surface of retaining strips 28 forces the edges of elastic diaphragm 26 against a matching surface of compression plate 20 subject to the force of tightened screws 27.

Other screws 29 extend through holder 24 into an elastic hose 30 that can be filled with pressure medium, securing the holder to elastic diaphragm 26.

Pressure-medium hose 30 is made out of rubber or plastic for example, is connected to one or more pressure-medium connections 31 in compression plate 20 or in a comparable structure, can be subjected to variable pressure, constituting a compression space, and can be exchanged by unscrewing screws 29. The hose extends along the inside surface of holder 24, both serving as a resilient support for the holder and providing it with a controlled flow of pressure medium.

Although pressure-medium hose 30 can be round, it can also, as illustrated in FIG. 2, be semiround in order to exert pressure against elastic diaphragm 26 and holder 24 over the widest possible surface.

An embodiment of the type illustrated in FIG. 2, with a pressure-medium hose and a diaphragm, has several advantages. It is impossible for sealing pressure to migrate toward the compression plate. The sealing groove 25, 40 (FIGS. 4–5) between frame 24, 37, 42 and the wall of the groove can be manufactured to a wide tolerance. The advancing forces propagated by the revolving compression belt on the frame can be directly introduced into the supporting structure by the diaphragm in accordance with the invention at any point in the frame.

It is possible within the scope of the invention to employ, instead of a pressure-medium hose on the inside of the diaphragm as illustrated in FIG. 2, a rigid penetrating strip that can be securely attached to the frame for example with screws. This introduces the sealing pressure into groove 22 and forces the overall seal, the rigid strip and the frame along with the seal, that is, against the revolving compression belt.

In the various embodiments illustrated in FIGS. 4 through 8, the pressure medium supplied from the pressure-medium line, 31 for example, acts directly on the particular diaphragm 32, 33, 34, 35, or 36, directly securing either the frame and the seal (FIGS. 4 & 5) or the seal alone in various ways. Since continuous diaphragm 32, 33, 34, 35, or 36 always completely seals off the pressure space that it demarcates in conjunction with its associated compression plate 20, no pressure medium can escape from the pressure space even at high pressure.

In the embodiment illustrated in FIG. 4, frame 37 is attached, to the bottom of diaphragm 32 for example, with a screw 38 and the laterally tensioned edges of the diaphragm secured in such a way that they can be released in a multipart compression plate 20 by screws 39. Frame 37 has enough play in groove 40, even though it cannot tilt, to allow lower sealing strip 41 to freely adapt to any unevenness in compression belt 12.

Figure 5:
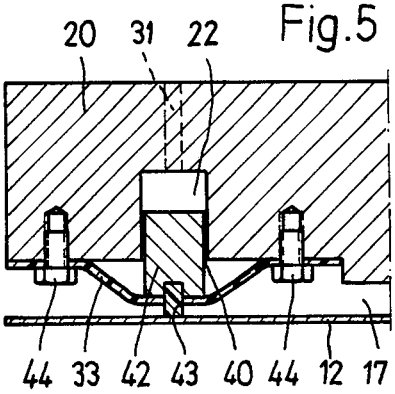
FIG. 5 is a partial section along line II—II in FIG. 1 of another variant embodiment.

In the embodiment illustrated in FIG. 5, a diaphragm 33 is attached to the bottom of frame 42, with sealing strip 43 passing through the diaphragm.

Figure 6:
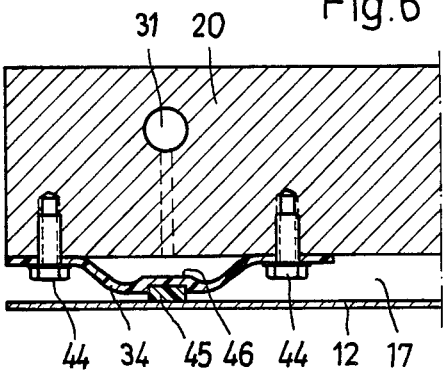
FIG. 6 is a partial section along line II—II in FIG. 1 of still another variant embodiment without a groove.
Figure 7:
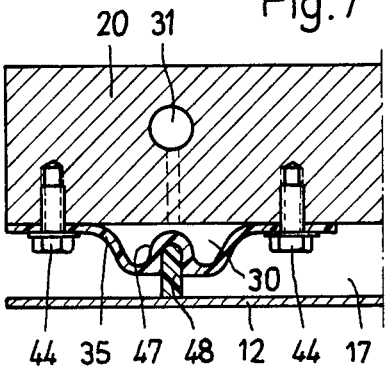
FIG. 7 is a partial section along line II—II in FIG. 1 of a fourth variant embodiment.

The embodiment illustrated in FIG. 6 lacks both a frame and built-in pressure space. Its diaphragm is fastened to and can be released from the bottom of compression plate 20 by screws 44 and secures a flat sealing strip 45 in a groove 46 in diaphragm 34. This design is also evident in the embodiment illustrated in FIG. 7, in which diaphragm 35 is secured by a grooved rib 47 that surrounds sealing strip 48 with an extensive surface and prevents it from tipping.

Figure 8:
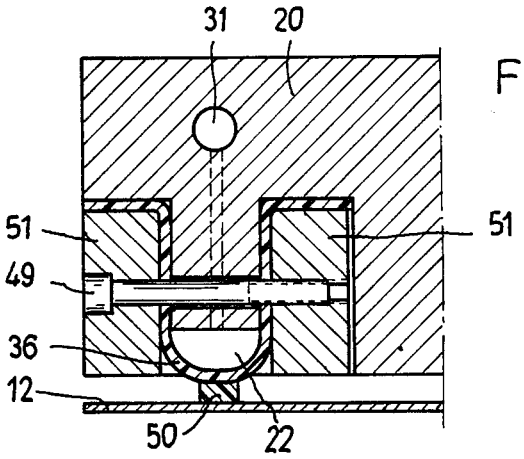
FIG. 8 is a partial section along line II—II in FIG. 1 of a fifth variant embodiment without a groove.

The embodiment illustrated in FIG. 8 exhibits an essentially U-shaped diaphragm 36. One arm of the U is tensioned in a groove in compression plate 20 by means of a transverse screw 49. A sealing strip 50 adheres to the bottom (outside) of diaphragm 36 and the borders of the diaphragm are tensioned by means of lateral strips 51, secured by the aforesaid screw 49, many of which are incorporated at intervals along the length of diaphragm 36.

In the embodiments illustrated in FIGS. 4 through 8, the pressure space constituted by pressure-medium hose 30 consists of the various opposing surfaces of compression plate 20 and of diaphragms 32, 33, 34, 35, or 36, moving sealing strip 23 perpendicular to compression belt 12.

It will be appreciated that the instant specification and claims are set forth by way of illustration and not limitation, and that various modifications and changes may be made without departing from the spirit and scope of the present invention.

What is claimed is:

1. In a device for applying surface pressure to workpieces advancing on at least one movable compression belt having means for forcing the belt against the workpiece including means forming a first pressure chamber adjacent to the belt and receptive of a pressure medium including a compression plate and a continuous sealing strip between the compression plate and belt for sealing off the first pressure chamber, the improvement comprising means mounting the sealing strip to the compression plate comprising an elongated diaphragm disposed around the edge of the first pressure chamber, means attaching the sealing strip to a surface of the diaphragm facing the belt, means forming a second pressure chamber between the compression plate and the diaphragm and receptive of a pressure medium and including means connecting the edges of the diaphragm to the compression plate for sealing off the second pressure chamber from the first pressure chamber to form an additional elastic seal, with the surface of the diaphragm facing away from the sealing strip being subjected to the pressure medium, whereby the compression force between the sealing strip and the belt can be increased by the pressure medium in the second pressure chamber to prevent the escape of pressure medium from the first pressure chamber.

2. The device as in claim 1, further comprising a surrounding groove positioned in the vicinity of the edge of the compression plate and means tensioning the edges of the diaphragm against the walls of the groove whereby pressure medium can be introduced into the space demarcated by the surfaces of the groove and by the diaphragm.

3. The device as in claim 1, further comprising a hose connected to the side of the elastic diaphragm that faces away from the sealing strip and which is fillable with pressure medium.

4. The device as in claim 3, further comprising a compressed-air line in the compression plate which communicates with the space inside the pressure-medium hose.

5. The device as in claim 3, further comprising a holder pointing toward the compression belt and fastened to the pressure-medium hose with the diaphragm in between them.

6. The device as in claim 1, wherein the means attaching the diaphragm to the compression plate comprises lateral retaining strips penetrated by screws.

7. The device as in claim 5, wherein the pressure-medium hose comprises a rigid strip that is releasably attachable to the holder.

8. The device as in claim 1, wherein said sealing strip is directly attached to the side of the diaphragm that faces the compression belt.

9. The device as in claim 8, wherein the diaphragm has a groove that partly accommodates the sealing strip.

10. The device as in claim 1, wherein the means mounting the sealing strip comprises a frame attached to side of the diaphragm that faces away from the compression belt and wherein the sealing strip penetrates the diaphragm.

* * * * *